US007834761B2

(12) United States Patent
Leone

(10) Patent No.: US 7,834,761 B2
(45) Date of Patent: Nov. 16, 2010

(54) H-BRIDGE ACTIVATOR/DEACTIVATOR AND METHOD FOR ACTIVATING/DEACTIVATING EAS TAGS

(75) Inventor: Steven V. Leone, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 366 days.

(21) Appl. No.: 11/667,991

(22) PCT Filed: Nov. 18, 2005

(86) PCT No.: PCT/US2005/041678

§ 371 (c)(1),
(2), (4) Date: Sep. 15, 2008

(87) PCT Pub. No.: WO2006/057887

PCT Pub. Date: Jun. 1, 2006

(65) Prior Publication Data

US 2009/0121871 A1 May 14, 2009

Related U.S. Application Data

(60) Provisional application No. 60/629,956, filed on Nov. 22, 2004.

(51) Int. Cl.
*G08B 13/24* (2006.01)

(52) U.S. Cl. ..... 340/551; 340/572.3

(58) Field of Classification Search ..... 340/551, 340/572.1, 572.3, 572.4, 568.1, 568.8; 607/58
See application file for complete search history.

(56) References Cited

U.S. PATENT DOCUMENTS

| | | | | |
|---|---|---|---|---|
| 4,524,773 | A * | 6/1985 | Fischell et al. | 607/58 |
| 5,210,524 | A * | 5/1993 | Schwarz et al. | 340/551 |
| 5,805,065 | A * | 9/1998 | Schwarz et al. | 340/551 |
| 2008/0088460 | A1 * | 4/2008 | Copeland | 340/572.7 |

* cited by examiner

*Primary Examiner*—Van T. Trieu

(57) ABSTRACT

A method and an apparatus and system are disclosed for activating, deactivating or reactivating an electronic article surveillance (EAS) label by way of a coil antenna in an H-bridge circuit which generates from the antenna: a positive increasing magnetic field; a positive decreasing magnetic field; a negative increasing magnetic field; and a negative decreasing magnetic field. The positive and negative magnetic fields are created by positive and negative currents directed through the antenna by four switches connected to the antenna in an H-bridge configuration. The method and apparatus enable low voltage activation, deactivation or reactivation of an EAS tag, e.g., at voltage levels of 12 to 24VDC, ensure uninterruptible power in case of loss of external power, and portability without a high voltage capacitor which is normally required in large deactivation designs. Activation and reactivation is by an increasing magnetic field followed by a decreasing magnetic field without altering polarity.

20 Claims, 8 Drawing Sheets

H-BRIDGE ACTIVATOR/DEACTIVATOR AND METHOD FOR ACTIVATING/DEACTIVATING EAS TAGS

CROSS-REFERENCE TO RELATED APPLICATIONS

This application claims the benefit of priority under 35 U.S.C. §119 to U.S. Provisional Patent Application 60/629,956 filed on Nov. 22, 2004 entitled "H-Bridge Deactivator", the entire contents of which is incorporated by reference herein.

BACKGROUND OF THE INVENTION

1. Field of the Invention

This invention relates to an H-bridge deactivator that utilizes an H-bridge switch network to perform activation, deactivation or reactivation of an electronic article surveillance (EAS) tag and particularly to activation, deactivation or reactivation of an acoustomagnetically activated EAS tag.

2. Description of the Related Art

Acoustomagnetically activated EAS tags are typically demagnetized by a strong magnetic alternating field with a slowly decaying field strength, Conversely, acoustomagnetically activated EAS tags can only be initially activated or subsequently reactivated by magnetizing with a strong constantly positive or constantly negative magnetic field with a slowly decaying field strength.

Therefore, existing acoustomagnetic (AM) deactivators require either high voltage (110VAC—volts alternating current) or very high voltage (200-500VDC—volts direct current) in order to generate the high currents required to produce a magnetic field of sufficient magnitude to deactivate an EAS tag. The voltages required impose special safety concerns that tend to constrain the design. Furthermore, if power is interrupted or lost, the deactivator will not work for that period of time and such deactivators are not portable. The prior solutions address uninterruptible power and portability regarding a small handheld deactivator, but not for a large deactivator or a low voltage deactivator.

SUMMARY

It is an object of the present disclosure to provide an alternate method for activation, deactivation, or reactivation of an EAS acoustomagnetically activated tag by utilizing an H-bridge circuit to generate the alternating and decaying currents required for activation, deactivation or reactivation.

It is another object of the disclosure to enable low voltage activation, deactivation or reactivation of an EAS tag, e.g., at voltage levels of 12 to 24VDC.

Still another object of the present disclosure is to ensure uninterruptible power for activation, deactivation or reactivation of an EAS tag in case of loss of external power.

It is yet another object of the present disclosure to provide a portable apparatus for activation, deactivation or reactivation of an EAS tag.

For example, in one embodiment of the present disclosure, activation, deactivation or reactivation of an EAS tag is accomplished without a high voltage capacitor that is required typically in large deactivation designs, thereby lowering cost and enhancing safety.

It is an object of the present disclosure to provide alternate methods of activation, deactivation or reactivation so that a designer may optimize for a particular environment.

In particular, the present disclosure is directed to an apparatus for activating, deactivating or reactivating an electronic article surveillance (EAS) tag by means of an H-bridge circuit coupled to an antenna. The H-bridge circuit is adapted to connect to a source of current to the circuit and is configured to direct an increasing current flow through the antenna in a first direction, thereby generating a positive increasing magnetic field from the antenna. In one particularly useful embodiment, the H-bridge is configured to direct a decreasing current flow through the antenna in the first direction, thereby generating a positive decreasing magnetic field from the antenna. The H-bridge circuit may also be configured to direct an increasing current flow through the antenna in a second direction such that the direction of current flow through the antenna reverses, thereby generating a negative increasing magnetic field from the antenna. In another particularly useful embodiment, the H-bridge circuit is configured to direct a decreasing current flow through the antenna in the second direction, thereby generating a negative decreasing magnetic field from the antenna.

In one embodiment, the circuit includes at least four switches and an antenna having first and second ends for directing current through the antenna. The first and third switches are coupled to a first junction, and the second and fourth switches are coupled to a second junction. The first and fourth switches are coupled to a third junction, and the second and third switches are coupled to a fourth junction. The first end of the antenna is coupled to the third junction, and the second end of the antenna is coupled to the fourth junction. As a result, the first switch controls current between the first junction and the third junction, the second switch controls current between the second junction and the fourth junction, the third switch controls current between the first junction and the fourth junction, and the fourth switch controls current between the second junction and the third junction.

The apparatus may also include a circuit controller controlling the circuit to generate in at least a first cycle a positive increasing magnetic field from the antenna. More particularly, following connection of a source of DC power between the first and second junctions, the circuit controller opens the third and fourth switches, and closes the first switch to direct current from the first junction to the third junction; and closes the second switch to direct current from the fourth junction to the second junction, thereby directing an increasing current through the antenna in a first direction from the third junction to the fourth junction. The circuit controller may also be configured to further control the circuit to generate in the first cycle a positive decreasing magnetic field from the antenna by: disconnecting the source of DC power between the first and second junctions; opening the first, third and fourth switches; and closing the second switch, thereby directing a decreasing current through the antenna in the first direction from the third junction to the fourth junction.

The circuit controller may be particularly configured to continue to control the circuit to generate in the at least a first cycle a negative increasing magnetic field from the antenna. More particularly, upon connecting a source of DC power between the first and second junctions, the circuit controller opens the first and second switches, and closes the third switch to direct current from the first junction to the fourth junction; and closes the fourth switch to direct current from the third junction to the second junction, thereby directing increasing current through the antenna in a second direction from the fourth junction to the third junction.

The circuit controller may also be configured to control the circuit to generate in at least the first cycle a negative decreasing magnetic field from the antenna. More particularly, upon disconnecting the source of DC power between the first and second junctions, the circuit controller opens the first, second and third switches; and closes the fourth switch, thereby directing decreasing current through the antenna in the second direction from the fourth junction to the third junction.

It is envisioned that second and succeeding cycles repeat in a similar manner the actions occurring during the first cycle, i.e., generating a positive increasing magnetic field, generating a positive decreasing magnetic field, generating a negative increasing magnetic field and generating a negative decreasing magnetic field. It is contemplated that the cycle time of the first cycle exceeds cycle time of the second cycle, and the cycle time of each succeeding cycle consecutively decreases with respect to the cycle time of the second cycle.

Typically, the antenna is an inductance coil antenna and the switches are high current transistors or field effect transistors. The current source may include an AC/DC converter providing DC output, with the AC/DC converter being coupled to a source of AC power. The current source may further include a DC/DC High Voltage converter coupled to the AC/DC converter, with the DC/DC High Voltage converter providing DC High Voltage output. Alternatively, the current source may include a battery, or may further include an AC/DC charger coupled to the battery to provide DC output, with the AC/DC charger being coupled to a source of AC power.

The DC output of the AC/DC converter may be either 12 VDC, 24 VDC, or 110 VDC. The DC High Voltage output from the DC/DC High Voltage converter may be greater than 110 VDC. The voltage output of the battery may be either 12 VDC or 24 VDC. The voltage output of the AC/DC charger may be either 12 VDC or 24 VDC. The source of AC power may be 110 to 120 VAC.

In addition, the present disclosure is directed to a method of deactivating an electronic article surveillance (EAS) tag which includes the steps of: providing an H-bridge circuit coupled to an antenna; applying a source of current to the H-bridge circuit; directing an increasing current flow through the antenna in a first direction, thereby generating a positive increasing magnetic field from the antenna; directing a decreasing current flow through the antenna in the first direction, thereby generating a positive decreasing magnetic field from the antenna; directing an increasing current flow through the antenna in a second direction such that current flow through the antenna reverses, thereby generating a negative increasing magnetic field from the antenna; and directing a decreasing current flow through the antenna in the second direction, thereby generating a negative decreasing magnetic field from the antenna. In another particularly useful embodiment, the present disclosure is directed to a method of activating or reactivating the electronic article surveillance (EAS) tag which includes the steps of: providing an H-bridge circuit coupled to an antenna; applying a source of current to the H-bridge circuit; directing an increasing current flow through the antenna in a defined direction, thereby generating an increasing magnetic field from the antenna; and directing a decreasing current flow through the antenna in the defined direction, thereby generating a decreasing magnetic field from the antenna. In one particularly useful embodiment, the defined direction is a first direction such that the increasing magnetic field is a positive increasing magnetic field and the decreasing magnetic field is a positive decreasing magnetic field. In one particularly useful embodiment, the defined direction is (a second direction reverse to the first direction) such that the increasing magnetic field is a negative increasing magnetic field and the decreasing magnetic field is a negative decreasing magnetic field.

In particular, in one embodiment of implementing the method, the antenna may include first and second ends for directing current through the antenna and the H-bridge circuit includes at least first, second, third and fourth switches. The first and third switches are coupled to a first junction. The second and fourth switches coupled to a second junction. The first and the fourth switches are coupled to a third junction. The second switch and the third switch are coupled to a fourth junction. The first end of the antenna is coupled to the third junction and the second end of the antenna is coupled to the fourth junction. The first switch controls current between the first junction and the third junction and the second switch controls current between the second junction and the fourth junction. The third switch controls current between the first junction and the fourth junction, and the fourth switch controls current between the second junction and the third junction.

More specifically, it is envisioned that the method may also include implementing the step of directing an increasing current flow through the antenna in a first direction by, in at least a first cycle: connecting the current source between the first and second junctions; opening the third and fourth switches; closing the first switch to direct current from the first junction to the third junction; and closing the second switch to direct current from the fourth junction to the second junction, thereby directing from the third junction to the fourth junction an increasing current through the antenna in the first direction to generate the positive increasing magnetic field.

Furthermore, it is contemplated that the method may also include implementing the step of directing a decreasing current flow through the antenna in a first direction by, in the at least a first cycle: disconnecting the current source between the first and second junctions; opening the first, third and fourth switches; and closing the second switch, thereby directing a decreasing current through the antenna in the first direction from the third junction to the fourth junction to generate the positive decreasing magnetic field.

Additionally, it is envisioned that the method may also include implementing the step of directing an increasing current flow through the antenna in a second direction such that the current flow through the antenna reverses by, in the at least a first cycle: connecting a current source between the first and second junctions; opening the first and second switches; closing the third switch to direct current from the first junction to the fourth junction; and closing the fourth switch to direct current from the third junction to the second junction, thereby directing from the fourth junction to the third junction increasing current through the antenna in a second direction to generate the negative increasing magnetic field.

Still further, it is contemplated that the method may also include implementing the step of directing a decreasing current flow through the antenna in the second direction by, in the at least a first cycle: disconnecting the current source between the first and second junctions; opening the first, second and third switches; and closing the fourth switch, thereby directing decreasing current through the antenna in the second direction from the fourth junction to the third junction to generate the negative decreasing magnetic field.

The method is implemented typically such that the cycle time of the at least a first cycle exceeds the cycle time of a second cycle, and the cycle time of each succeeding cycle consecutively decreases with respect to the cycle time of the second cycle. Typically, the antenna is an inductance coil antenna.

It is envisioned that the system of the present disclosure includes an EAS label or tag in conjunction with the foregoing features and limitations of the apparatus of the present disclosure.

The disclosure provides an alternate method for activation, deactivation or reactivation. H-bridge activation, deactivation or reactivation provides for low voltage (12/24VDC) activation, deactivation or reactivation, uninterruptible power in case of loss of external power, and portability. Furthermore, H-bridge deactivator can perform activation, deactivation or reactivation without a high voltage capacitor, such as is required in most other large deactivation designs.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The following co-pending, commonly owned U.S. non-provisional patent applications are hereby incorporated by reference in their entirety: application Ser. No. 10/688,822 filed on Oct. 17, 2003, entitled "Electronic Article Surveillance Marker Deactivator Using Phase Control Deactivation"; and application Ser. No. 10/915,844 filed on Aug. 11, 2004, entitled "Deactivator Using Inductive Charging"; and commonly owned U.S. Pat. No. 6,946,962, issued on Sep. 20, 2005, entitled "Electronic Article Surveillance Marker Deactivator Using Inductive Discharge".

Numerous specific details may be set forth herein to provide a thorough understanding of the embodiments of the disclosure. It will be understood by those skilled in the art, however, that various embodiments of the disclosure may be practiced without these specific details. In other instances, well-known methods, procedures, components and circuits have not been described in detail so as not to obscure the various embodiments of the disclosure. It can be appreciated that the specific structural and functional details disclosed herein are representative and do not necessarily limit the scope of the disclosure.

It is worthy to note that any reference in the specification to "one embodiment" or "an embodiment" according to the present disclosure means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

Figure 1A:
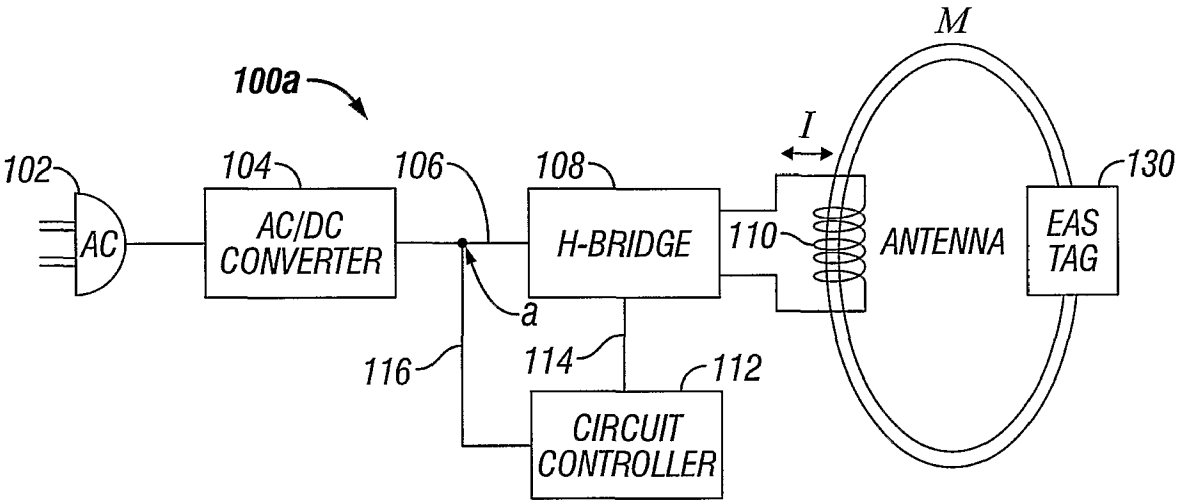
FIG. 1*a* illustrates a block diagram of an H-bridge acoustomagnetic deactivator that is powered by AC in accordance with one embodiment of the present disclosure.
Figure 1B:
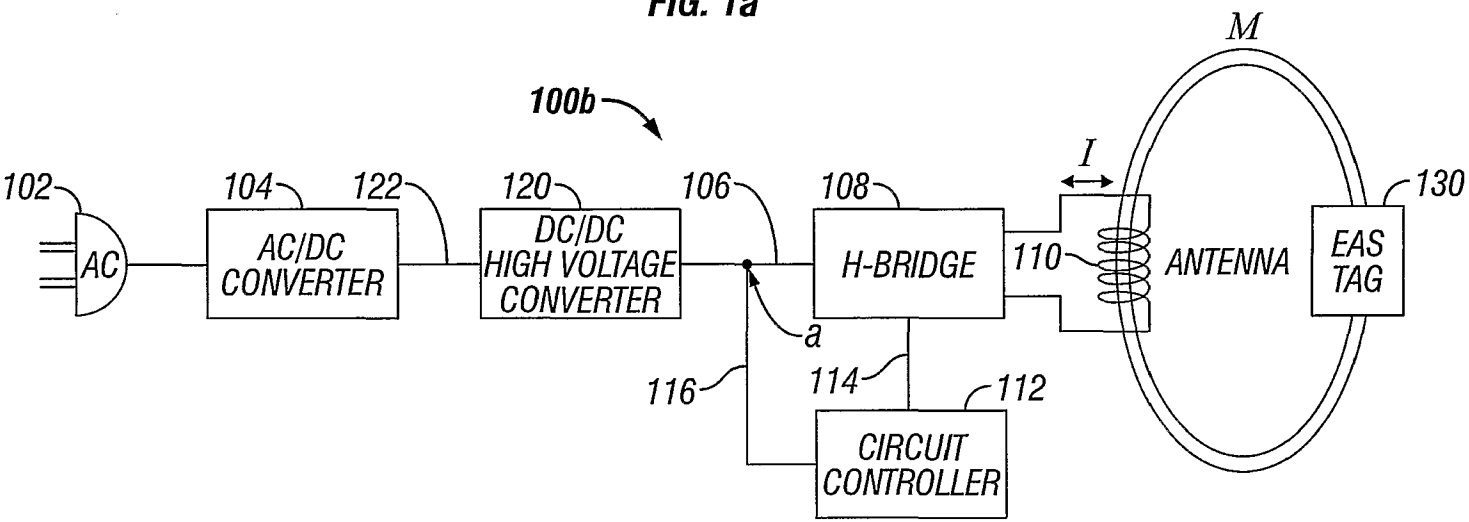
FIG. 1*b* illustrates a block diagram of an H-bridge acoustomagnetic deactivator which is powered by high voltage DC in accordance with an alternate embodiment of the present disclosure.
Figure 1C:
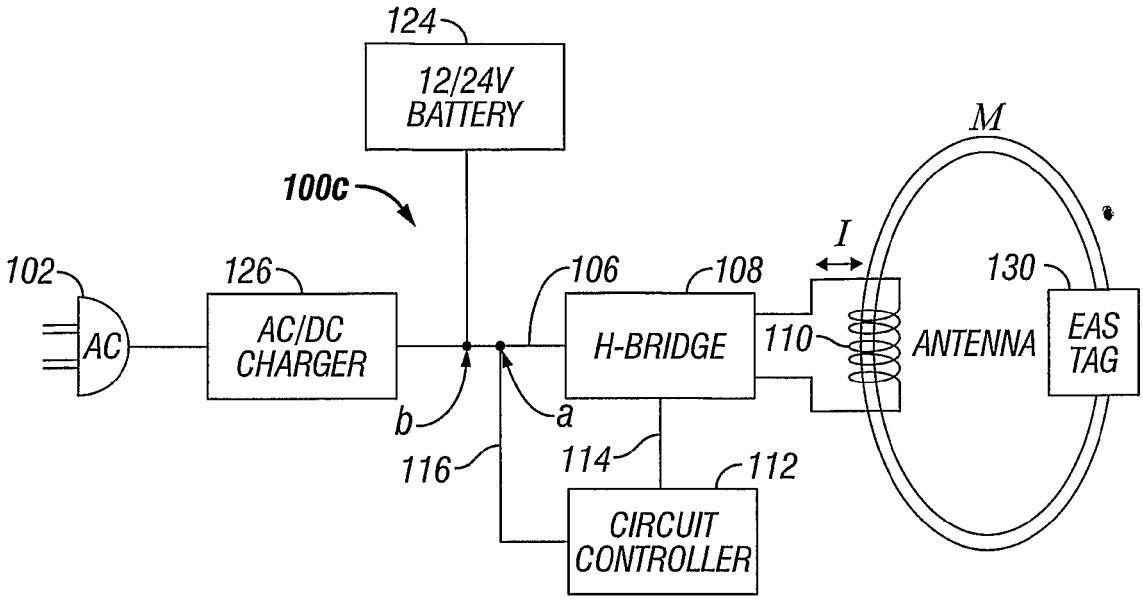
FIG. 1*c* illustrates a block diagram of an H-bridge acoustomagnetic deactivator which is powered by low voltage DC in accordance with an alternate embodiment of the present disclosure.

Referring now in detail to the drawings wherein like parts may be designated by like reference numerals throughout, the main components of an H-bridge deactivator are shown in FIGS. 1*a-c* for different input power conditioning. FIG. 1*a* illustrates a block diagram of an H-bridge acoustomagnetic deactivator 100*a* that is powered by AC in accordance with one embodiment of the present disclosure. Deactivator 100*a* may be configured to include a number of different elements or additional elements may be added to deactivator 100*a*, or be substituted for the representative elements shown in FIG. 1*a*, and those elements still fall within the scope of the embodiments described herein.

Specifically, AC input voltage source 102 provides current and is coupled to AC/DC converter 104. Typically, the AC input voltage may range from about 110 to about 120 VAC or from about 220 to about 240 VAC. AC/DC converter 104 transmits power to H-bridge 108 via line 106. Antenna 110 receives from the H-bridge 108 alternating and decaying currents "I" required to generate magnetic field "M" for deactivation of EAS tag 130. Alternatively, the constantly positive or constantly negative currents "I" can be applied to activate or reactivate EAS tag 130. A circuit controller section 112 controls activation, deactivation or reactivation timing of the H-bridge circuit 108. The circuit controller section 112 receives feedback from the H-bridge 108 via line 114 and transmits a feedback signal via line 116 to the input of the H-bridge 108 at junction "a" with line 106.

FIG. 1*b* illustrates a block diagram of an H-bridge acoustomagnetic deactivator 100*b* that is powered by high voltage DC in accordance with one embodiment. Similar to deactivator 100*a*, deactivator 100*b* may include a number of different elements. In particular, the H-bridge deactivator circuit 108 and associated components antenna 110, circuit controller section 112 and EAS tag 130 illustrated in FIG. 1*b* are identical to those illustrated in FIG. 1*a*, with the exception that DC/DC high voltage converter 120 is connected via line 106 upstream of junction "a" and connected to AC/DC converter 104 via line 122. Therefore, the DC output voltage of AC/DC converter 104 is increased by a DC/DC high voltage converter 120 (or in other ways known in the art) to supply high voltage DC to H-bridge circuit 108.

FIG. 1*c* illustrates a block diagram of an H-bridge acoustomagnetic deactivator 100*c* that is powered by DC in accordance with one embodiment. As with respect to FIG. 1*b*, the H-bridge deactivator circuit 108 and associated components antenna 110, control section 112 and EAS tag 130 illustrated in FIG. 1*c* are identical to those illustrated in FIG. 1*a*, with the exception that DC battery 124 is connected via line 106 at junction "b" which is upstream of junction "a" and connected to AC/DC charger 124. Battery 124 is a standard 12V or 24V car, boat, or small plane battery that provides energy storage capability and can be the main power supply input to H-bridge circuit 108. Typically, battery 124 has a high cold cranking current capacity in the range of 600 amps and an amp-hour rating in the range of 100 amp-hours.

Figure 2A:
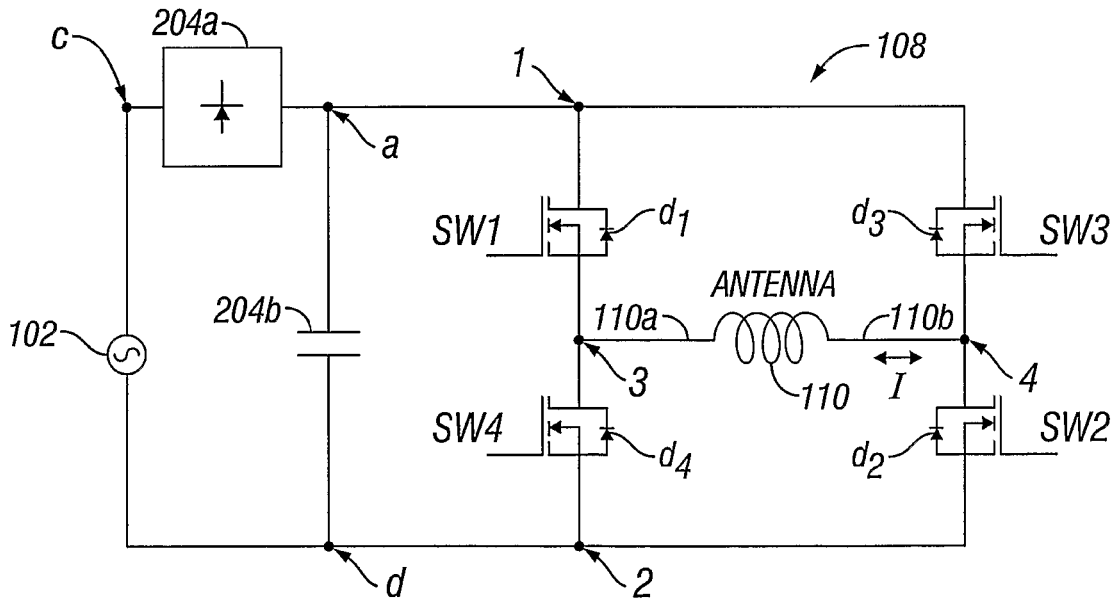
FIG. 2*a* illustrates a circuit diagram of the H-bridge circuit of FIG. 1*a* which is powered by AC in accordance with an alternate embodiment of the present disclosure.
Figure 2B:
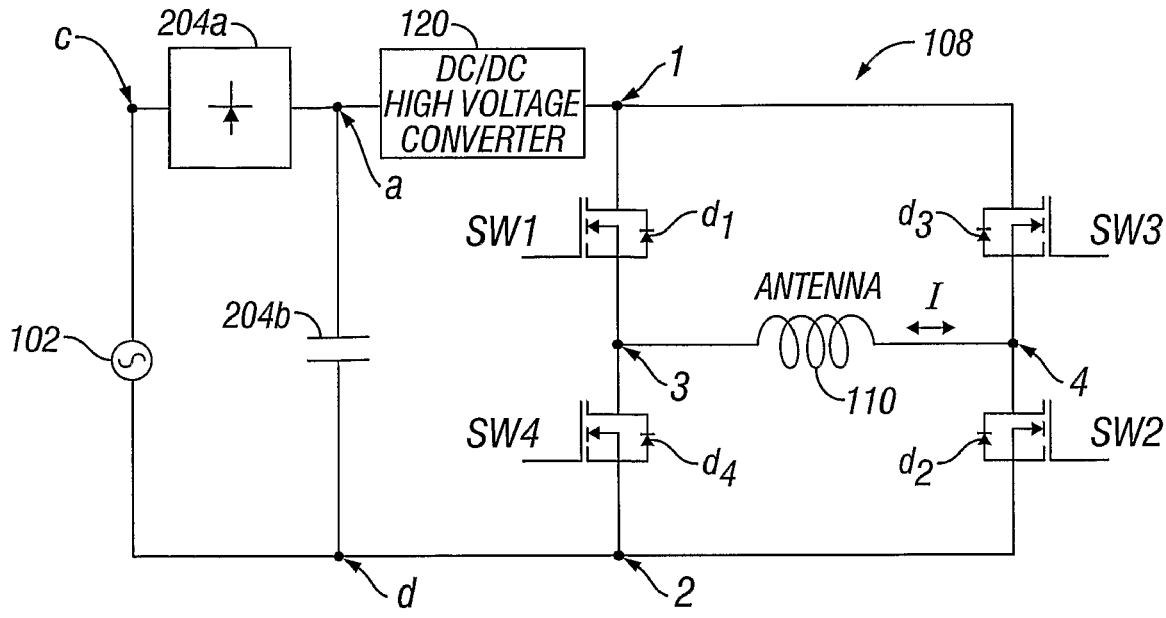
FIG. 2*b* illustrates a circuit diagram of the H-bridge circuit of FIG. 1*b* which is powered by high voltage DC in accordance with an alternate embodiment of the present disclosure.
Figure 2C:
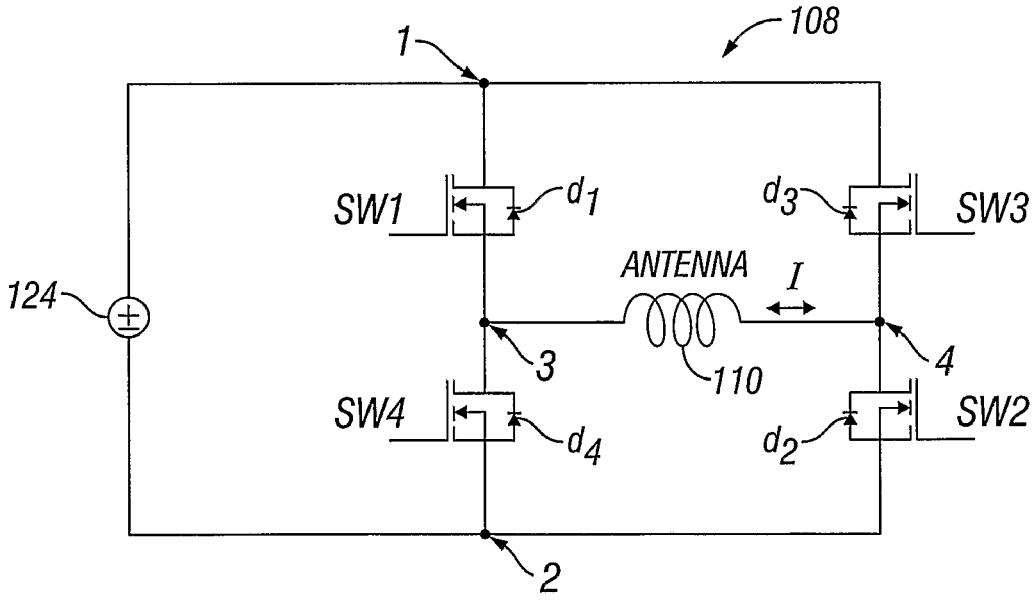
FIG. 2*c* illustrates a circuit diagram of the H-bridge circuit of FIG. 2*c* which is powered by DC in accordance with an alternate embodiment of the present disclosure.

FIGS. 2*a* to 2*c* illustrate an H-bridge circuit 108 which includes four switches SW1, SW2, SW3 and SW4 which are joined at junctions 1, 2, 3 and 4 to form a bridge. In particular, FIG. 2*a* illustrates a circuit diagram of the H-bridge circuit 108 of FIG. 1*a* that is powered by AC in accordance with one embodiment. Specifically, first switch SW1 is coupled to first junction 1 and to third junction 3, second switch SW2 is coupled to second junction 2 and to fourth junction 4, third switch SW3 is coupled to first junction 1 and to fourth junction 4, and fourth switch SW4 is coupled to third junction 3 and to second junction 2. First end 110*a* of coil antenna 110 is coupled to third junction 3 and second end 110*b* of coil antenna 110 is coupled to fourth junction 4. Thus, the first switch SW1, coupled to first junction 1 and to third junction 3, and third switch SW3, coupled to first junction 1 and to fourth junction 4, form a triangle with coil antenna 110. Similarly, the second switch SW2, coupled to second junction 2 and fourth junction 4, and fourth switch SW4, coupled to second junction 2 and third junction 3, also form a triangle with coil antenna 110. Thus, the first switch SW1 controls current between the first junction 1 and the third junction 3. The second switch SW2 controls current between the second junction 2 and the fourth junction 4. The third switch SW3 controls current between the first junction 1 and the fourth junction 4. The fourth switch SW4 controls current between the second junction 2 and the third junction 3. The switches SW1, SW2, SW3 and SW4 include high current transistors which produce currents "I" and, correspondingly, magnetic fields "M" from coil antenna 110 of sufficient magnitude to activate, deactivate or reactivate the EAS tag 130. AC voltage source 102 is coupled in series with rectifier 204*a* to junction 1 of the H-bridge circuit 108 through junction "c" and to junction 2 of the H-bridge circuit 108 through junction "d". Through junction "a", capacitor 204*b* is coupled to the H-bridge circuit 108 through junction 1 and, through junction "d", coupled to junction 2 of the H-bridge circuit 108. Consequently, the AC voltage source 102 and rectifier 204*a* are also coupled in parallel with capacitor 204*b* via junction "a" and junction "d". Therefore, AC voltage from the AC voltage source 102 is converted via rectifier 204*a* and capacitor 204*b* to DC and coupled to the H-bridge circuit 108 through junctions 1, 2, 3 and 4.

FIG. 2*b* illustrates a circuit diagram of the H-bridge circuit 108 of FIG. 1*b* that is powered by high voltage DC in accordance with one embodiment. In particular, the H-bridge deactivator circuit 108 and associated rectifier 204*a*, capacitor 204*b*, SW1, SW2, SW3, SW4 and antenna 110 are identical to those illustrated in FIG. 2*a*, with the exception that DC/DC high voltage converter 120 is connected upstream of junction "a". Consequently, high voltage DC is supplied to the H-bridge circuit 108 through junctions 1, 2, 3 and 4.

FIG. 2*c* illustrates a circuit diagram of the H-bridge circuit 108 of FIG. 1*c* that is powered by DC in accordance with one embodiment. In particular, the H-bridge deactivator circuit 108 and associated antenna 110 and SW1, SW2, SW3 and SW4 are identical to those illustrated in FIG. 2*a*, with the exception that DC battery 124 is connected at junctions "c" and "d" to supply DC power to the H-bridge deactivator 108 through junctions 1, 2, 3 and 4.

Figure 3:
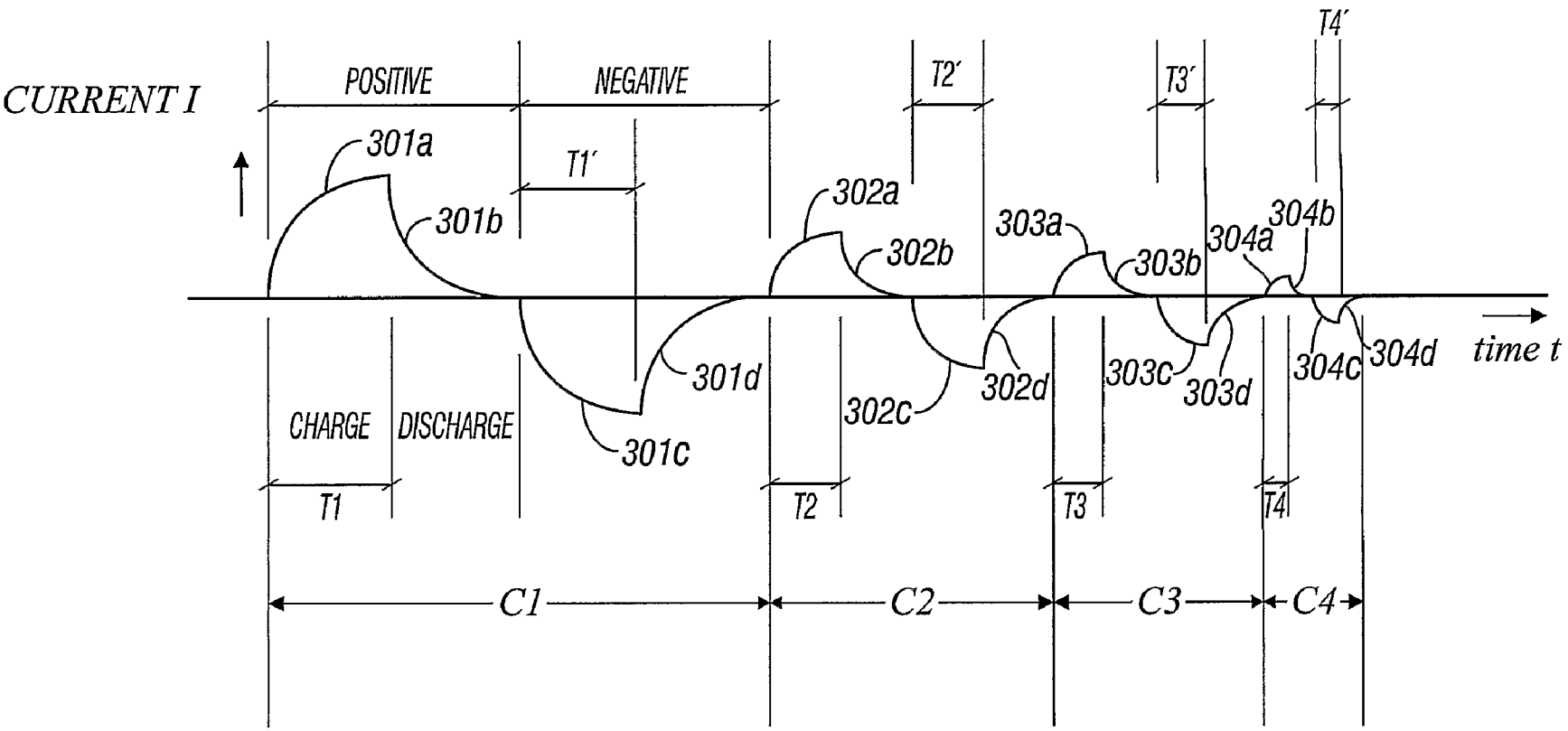
FIG. 3 illustrates a graph of the alternating antenna deactivation current as a function of time in accordance with an alternate embodiment of the present disclosure.

FIG. 3 illustrates a graph of the alternating antenna activation, deactivation or reactivation current as a function of time in accordance with one embodiment. Specifically, the current "I" is plotted as a function of time "t". During Switch "ON" times T1, T2, T3 and T4, positive charging currents 301*a*, 302*a*, 303*a* and 304*a* are generated. The positive charging currents 301*a*, 302*a*, 303*a* and 304*a* are followed by positive discharging currents 301*b*, 302*b*, 303*b* and 304*b* during which time the current "I" decays to zero. By reversing direction of current flow through the coil antenna 110, and again supplying power, negative charging currents 301*c*, 302*c*, 303*c* and 304*c* are generated. These negative charging currents 301*c*, 302*c*, 303*c* and 304*c* are followed by negative discharging currents 301*d*, 302*d*, 303*d* and 304*d*, during which time, the current "I" again decays to zero. As a result, with respect to FIGS. 2*a* to 2*c*, by alternating and adjusting the switch on times T1', T2', T3' and T4' of switches SW1, SW2, SW3 and SW4, an alternating and decaying current "I" can be generated through the coil antenna 110 for deactivation or a constant polarity positive magnetic field or a constant polarity negative magnetic field can be generated for activation or reactivation through the coil antenna 110.

In particular, following connection of the source of DC power, such as AC/DC converter 104, DC/DC High Voltage converter 120, battery 124 or AC/DC charger 126, between the first and second junctions 1 and 2, respectively, to apply current to the circuit 108, the circuit 108 generates in a first cycle C1 a positive increasing magnetic field from the antenna 110 by virtue of the circuit controller 112 opening the third switch SW3; opening the fourth switch SW4; closing the first switch SW1 to direct current "I" from the first junction 1 to the third junction 3; and closing the second switch SW2 to direct current "I" from the fourth junction 4 to the second junction 2, thereby directing an increasing current 301*a* through the antenna 110 in a first direction from the third junction 3 to the fourth junction 4.

The circuit controller 112 further generates in the first cycle C1 a positive decreasing magnetic field from the antenna 110 by disconnecting the source of DC power, (e.g., AC/DC converter 104, DC/DC High Voltage converter 120, battery 124 or AC/DC charger 126) between the first and second junctions 1 and 2, respectively; opening the first switch SW1; opening the third switch SW3; opening the fourth switch SW4; and closing the second switch SW2, thereby directing a decreasing current 301*b* through the antenna 110 in a first direction from the third junction 3 to the fourth junction 4.

The circuit controller 112 continues to generate in the first cycle C1 a negative increasing magnetic field from the antenna 110 by connecting a source of DC power (e.g., AC/DC converter 104, DC/DC High Voltage converter 120, battery 124 or AC/DC charger 126) between the first and second junctions, 1 and 2, respectively; opening the first switch SW1; opening the second switch SW2; closing the third switch SW3 to direct the current "I" from the first junction 1 to the fourth junction 4; and closing the fourth switch SW4 to reverse current flow through the antenna 10 by directing the current "I" from the third junction 1 to the second junction 2, thereby directing increasing current 301*c* through the antenna 110 in a second direction from the fourth junction 4 to the third junction 3 which is a direction reverse to the first direction.

In the first cycle, the circuit controller 112 is also configured to generate a negative decreasing magnetic field from the antenna 110 by disconnecting the source of DC power (i.e., an AC/DC converter 104, DC/DC High Voltage converter 120, battery 124 or AC/DC charger 126) between the first and second junctions, 1 and 2, respectively; opening the first switch SW1; opening the second switch SW2; opening the third switch SW3; and closing the fourth switch SW4, thereby directing decreasing current 301*d* through the antenna 110 in a second direction from the fourth junction 4 to the third junction 3.

In a second cycle C2 and succeeding cycles such as C3 and C4, following connection of the source of DC power between the first and second junctions, the circuit generates from the antenna 110 in the second and succeeding cycles C2 through C4 initially a positive increasing magnetic field, followed by positive decreasing magnetic field, a negative increasing magnetic field, and a negative decreasing magnetic field, by virtue of the circuit controller 112 repeating the same steps as disclosed above for the first cycle C1. Due to the magnitude of the currents 301*a* to 301*d* being greater than the magnitude of the currents 302*a* to 302*d*, and, in turn, the magnitude of the currents 302*a* to 302*d* being greater than the magnitude of the currents 303*a* to 303*d* and, in turn, the magnitude of the currents 303*a* to 303*d* being greater than the magnitude of the currents 304*a* to 304*d*, cycle time of the first cycle C1 exceeds cycle time of the second cycle C2, and cycle time of each succeeding cycle, such as cycles C3 and C4, consecutively decreases with respect to the cycle time of the second cycle C2.

As a result, the alternating current "I" can be designed to activate, deactivate or reactivate an AM label. It should be noted that while four positive charging Switch "ON" times T1, T2, T3 and T4 and four cycles C1 through C4 are illustrated in FIG. 3, those skilled in the art recognize that any number of Switch "ON" times, either greater than or less than four, and any number of cycles can be generated as required or preferred to activate, deactivate or reactivate a particular acoustomagnetic (AM) label.

The equations (1) and (2) for the current waveforms are as follows:

$$I=\{V/R\}[1-e^{\{-t/(L/R)\}}] \quad (1)$$

Equation (1) is the equation for charging the circuit.

$$I=\{V/R\}e^{-t/(L/R)} \quad (2)$$

Equation (2) is the equation for discharging the circuit, where for both Equations (1) and (2):

I=Current in amps (A)

V=Battery voltage (12 or 24VDC)

R=Antenna resistance in ohms (Ω)

e=Natural number 2.71828

L=Antenna inductance in henrys (H)

t=time in seconds (s)

As noted previously, the battery 124 is typically a standard car, boat or small plane battery with high cold cranking amps (~600) and a high amp-hour rating (~100). The antenna 110 is made from large gauge cable to minimize losses, wrapped "N" times in a loop of arbitrary shape, usually circular or square. This multiple looping around an area creates an inductance "L" and a resistance "R". The losses are proportional to the resistance "R". The rate of rise of the charge current "I" and the rate of discharge of that current "I" is proportional to the ratio of L/R. The ratio L/R is known as the time constant "τ".

The antenna resistance R is given by Equation (3) as follows:

$$R=\rho len \quad (3)$$

where len=length of the cable, and the length of the cable, len, is given by Equation (4), as follows:

$$len=NC \quad (4)$$

where C=circumference for a circular loop antenna is given by Equation (5), as follows:

$$C=\pi D \quad (5)$$

D=diameter of circle, and

N=number of turns or wraps of the antenna cable.

Then, for a circular antenna, the resistance R is given by Equation (6), as follows:

$$R=\rho N\pi/D \quad (6)$$

The antenna inductance L is given by Equation (7), as follows:

$$L=\mu N^2 A/len \quad (7)$$

where

μ=permeability of free space, i.e., $$\mu=4\times10^{-7}H/m$$

N=number of turns in the antenna, and

A=area of loop in the antenna.

The area of loop in the antenna is given by Equation (8), as follows:

$$A=\pi D^2/4 \quad (8)$$

for a circular antenna.

Figure 4:
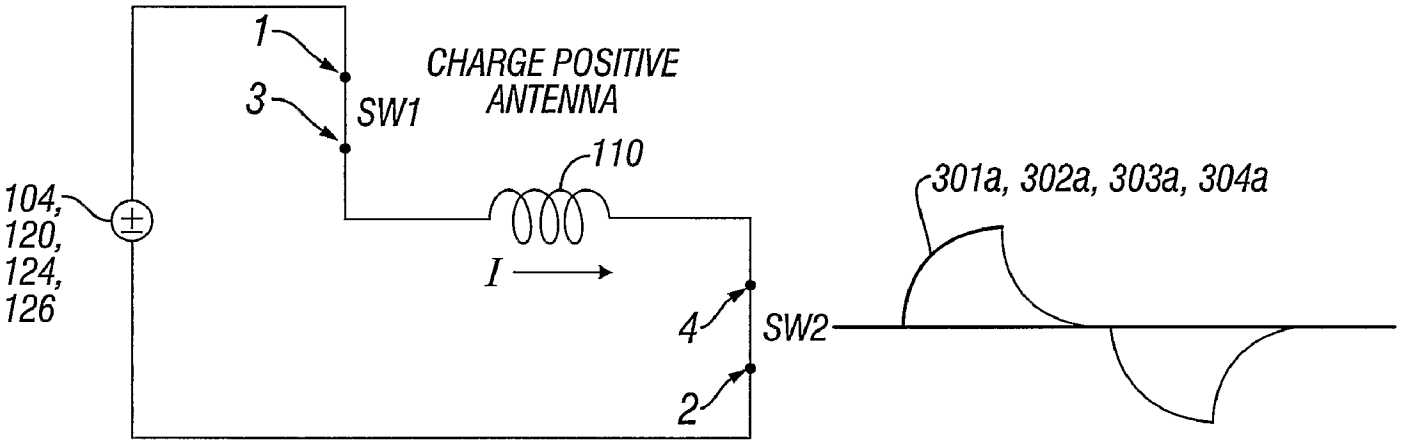
FIG. 4 illustrates an equivalent circuit diagram of the H-bridge circuit of FIGS. 2*a*, 2*b* and 2*c* illustrating the equivalent circuit configuration to provide positive charging current as a function of time.

FIG. 4 illustrates an equivalent circuit diagram of the H-bridge circuit of FIGS. 2*a*, 2*b* and 2*c* illustrating the equivalent circuit configuration to provide positive charging current "I" as a function of time "t" in accordance with one embodiment. Specifically, the positive charging currents 301*a*, 302*a*, 303*a* and 304*a* of FIG. 3 are generated through coil antenna 110 as illustrated in FIG. 4 by closing SW1 and SW2, with SW3 and SW4 being open, for the charge time T1, T2, T3 and T4. Equation (1) provides the calculation for the charging current "I".

Figure 5:
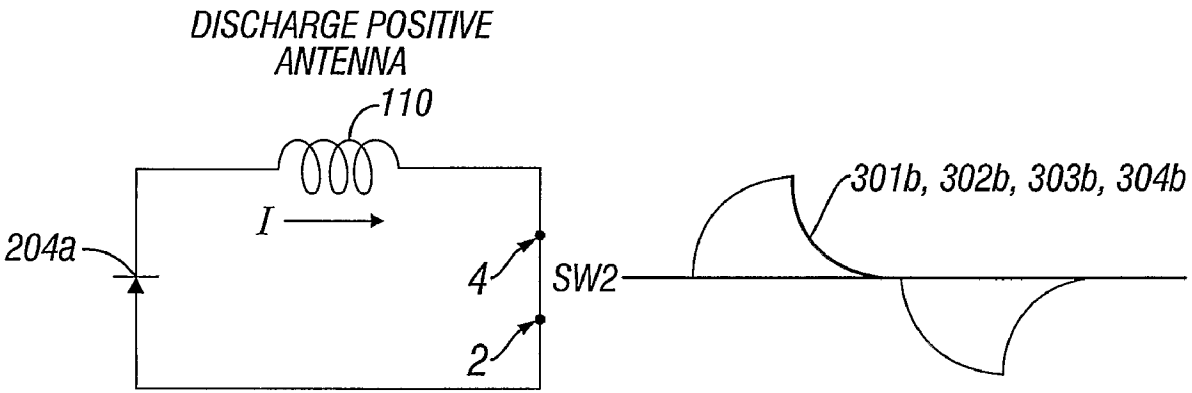
FIG. 5 illustrates an equivalent circuit diagram of the H-bridge circuit of FIGS. 2*a*, 2*b* and 2*c* illustrating the equivalent circuit configuration to provide positive discharging current as a function of time.

FIG. 5 illustrates an equivalent circuit diagram of the H-bridge circuit of FIGS. 2*a*, 2*b* and 2*c* illustrating the equivalent circuit configuration to provide positive discharging current "I" as a function of time "t" in accordance with one embodiment. Specifically, the positive discharging currents 301*b*, 302*b*, 303*b* and 304*b* of FIG. 3 are generated through coil antenna 110 as illustrated in FIG. 5 by closing SW2, with SW1, SW3, and SW4 being open, for the discharge time. Equation (2) provides the calculation for the discharging current "I".

Figure 6:
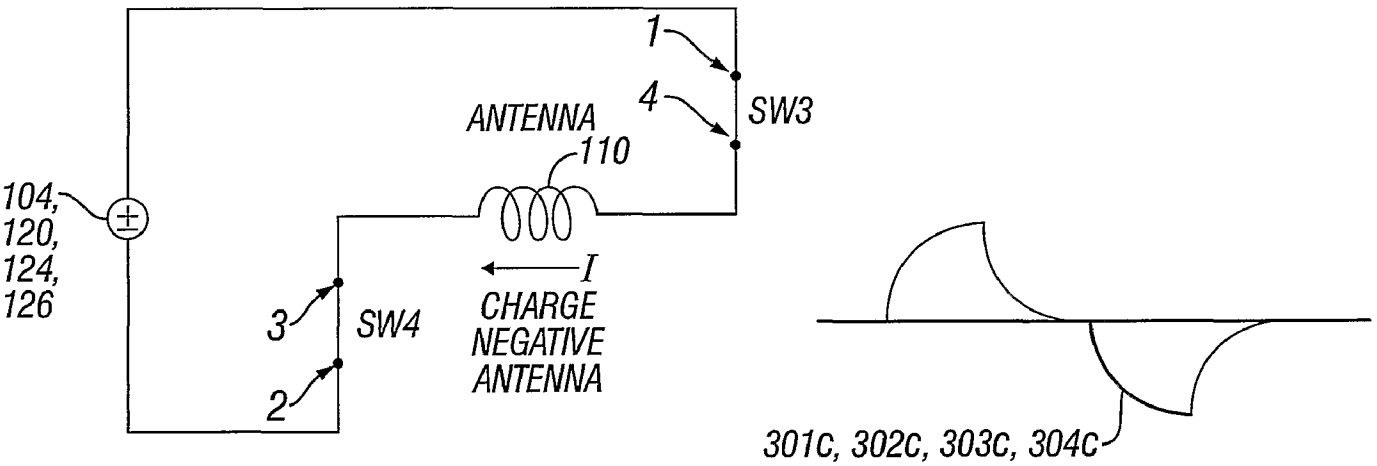
FIG. 6 illustrates an equivalent circuit diagram of the H-bridge circuit of FIGS. 2*a*, 2*b* and 2*c* illustrating the equivalent circuit configuration to provide negative charging current as a function of time.

FIG. 6 illustrates an equivalent circuit diagram of the H-bridge circuit of FIGS. 2*a*, 2*b* and 2*c* illustrating the equivalent circuit configuration to provide negative charging current "I" as a function of time "t" in accordance with one embodiment. Specifically, the negative charging currents 301*c*, 302*c*, 303*c* and 304*c* of FIG. 3 are generated through coil antenna 110 as illustrated in FIG. 6 by closing SW3 and SW4, with SW1 and SW2 being open for the charge time. The negative charging currents are generated by increasing current through the coil antenna 110 with the currents 301*c*, 302*c*, 303*c* and 304*c* being in the direction opposite to that of the positive charging currents 301*a*, 302*a*, 303*a* and 304*a* illustrated in FIG. 4. Again, Equation (1) provides the calculation for the charging current "I".

Figure 7:
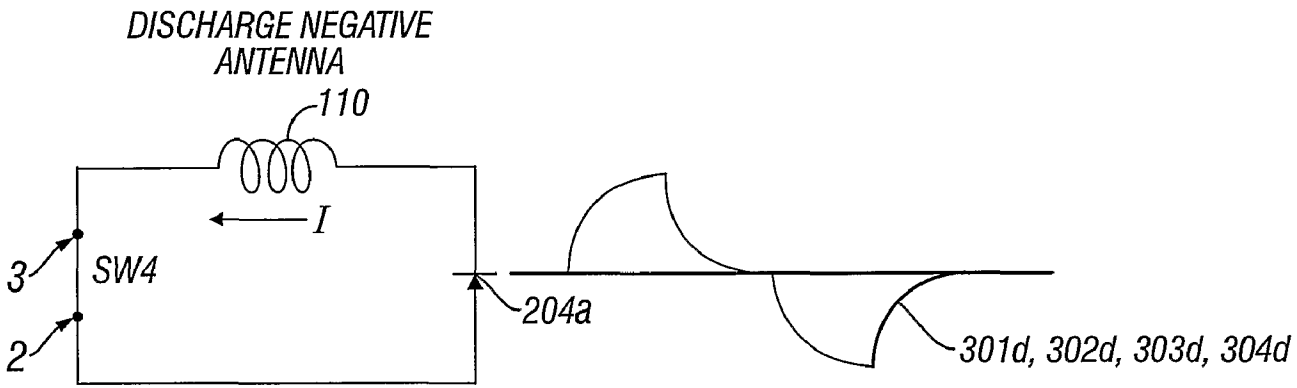
FIG. 7 illustrates an equivalent circuit diagram of the H-bridge circuit of FIGS. 2*a*, 2*b* and 2*c* illustrating the equivalent circuit configuration to provide negative discharging current as a function of time.

FIG. 7 illustrates an equivalent circuit diagram of the H-bridge circuit of FIGS. 2*a*, 2*b* and 2*c* illustrating the equivalent circuit configuration to provide negative discharging current "I" as a function of time in accordance with one embodiment. Specifically, the negative discharging currents 301*d*, 302*d*, 303*d* and 304*d* of FIG. 3 are generated through coil antenna 110 as illustrated in FIG. 7 by closing SW4, with SW1, SW2, and SW3 being open for the discharge time. Again, Equation (2) provides the calculation for the discharging current "I".

Decaying amplitude pulses, i.e. discharging currents, are calculated by solving Equations (1) and (2) for time "t" at a desired current "I".

Since the Amp-Turns product (AT) is a measure of the magnetic field strength of the activator, deactivator or reactivator, the activation, deactivation or reactivation energy is a function of the number of turns required to generate the magnetic field strength required to deactivate an EAS tag. AT is the product of the number of turns (N) times the peak current (I). An AT product of 10000-15000 is comparable to existing deactivators of similar size. Since I=V/R, the product AT is calculated by first determining the resistance R as a function of the number of turns N, as given by Equation (9), as follows:

$$R(N)=\rho N\pi+0.01 \tag{9}$$

where 0.01 is the resistance in ohms (Ω) of two power field effect transistors (FETs) and ρ is the electrical resistivity of the metal conductor cable in ohm/ft. FETs when in the ON position are high current transistors and when in the OFF position are high impedance transistors.

The action state of each of the switches in their ON and OFF positions is disclosed in the following table:

| ACTION STATE | SW1 | SW2 | SW3 | SW4 |
|---|---|---|---|---|
| Positive Charging 301a, 302a, 303a, 304a | ON | ON | OFF | OFF |
| Positive Discharging 301b, 302b, 303b, 304b | OFF | ON | OFF | OFF |
| Negative Charging 301c, 302c, 303c, 304c | OFF | OFF | ON | ON |
| Negative Discharging 301d, 302d, 303d, 304d | OFF | OFF | OFF | ON |

An acoustomagnetic EAS tag such as EAS tag 130 can be activated or reactivated by coupling to just the positive charging magnetic fields 301*a*, 302*a*, 303*a*, 304*a* and to the positive discharging magnetic fields 301*b*, 302*b*, 303*b*, 304*b* or by coupling to just the negative charging magnetic fields 301*c*, 302*c*, 303*c*, 304*c* and to the negative discharging magnetic fields 301*d*, 302*d*, 303*d*, 304*d*, but not to an alternating magnetic field which varies from positive to negative or from negative to positive. As a result, it is contemplated that the H-bridge circuit 108 is not only a deactivator circuit but also an activator or a reactivator circuit.

A method of activating or reactivating the electronic article surveillance (EAS) tag 130 includes the steps of: providing the H-bridge circuit 108 coupled to the antenna 110; applying a source of current I to the H-bridge circuit 108; directing an increasing current flow I through the antenna 110 in a defined direction, thereby generating an increasing magnetic field M from the antenna 110; and directing a decreasing current flow I through the antenna 110 in the defined direction, thereby generating a decreasing magnetic field M from the antenna 110. In one particularly useful embodiment, the defined direction is a first direction such that the increasing magnetic field M is a positive increasing magnetic field and the decreasing magnetic field M is a positive decreasing magnetic field M. In one particularly useful embodiment, the defined direction is a second direction reverse to the first direction such that the increasing magnetic field M is a negative increasing magnetic field and the decreasing magnetic field M is a negative decreasing magnetic field M.

More particularly, referring to FIGS. 4 and 5, coupling of EAS tag 130 to just the positive charging magnetic fields 301*a*, 302*a*, 303*a*, 304*a* and to the positive discharging magnetic fields 301*b*, 302*b*, 303*b*, 304*b* can be effected, as previously discussed, by operating only switches SW1 and SW2. Switches SW1, SW2, SW3 and SW4 each include a bypass diode d1, d2, d3 and d4, respectively, which bypasses the switch to allow current decay in the normal direction of current flow through the respective switch upon closure of the switch while disallowing current flow in the reverse direction. Therefore, although reactivation requires direct operation of only switches SW1 and SW2, decay current flow still occurs through diode d3 or d4, depending upon the original circuit configuration, even though switches SW3 and SW4 remain closed, so that three switches are required for reactivation, i.e., SW1, SW2 and SW3 or SW1, SW2 and SW4.

Similarly, referring to FIGS. 6 and 7, coupling of EAS tag 130 to just the negative charging magnetic fields 301*c*, 302*c*, 303*c*, 304*c* and to the negative discharging magnetic fields 301*d*, 302*d*, 303*d*, 304*d* can be effected, as previously discussed, by operating only switches SW3 and SW4. Again, although reactivation requires direct operation of only switches SW3 and SW4, decay current flow still occurs through diode d1 or d2, depending upon the original circuit configuration, even though switches SW1 and SW2 remain closed, so that three switches are required for reactivation, i.e., SW3, SW4 and SW1 or SW3, SW4 and SW2.

In view of Equation (9) for the resistance R(N), then the current "I" as a function of N is calculated by Equation (10), as follows:

$$I(N)=V/R(N) \tag{10}$$

where V=110VDC for AC/DC applications, or V>110VDC for DC/DC high voltage application or V=12VDC or 24VDC for battery application.

The number of ampere-turns AT or NI (N) as a function of the number of turns N is given by Equation (11), as follows:

$$NI(N)=N\cdot I(N) \tag{11}$$

Figure 8A:
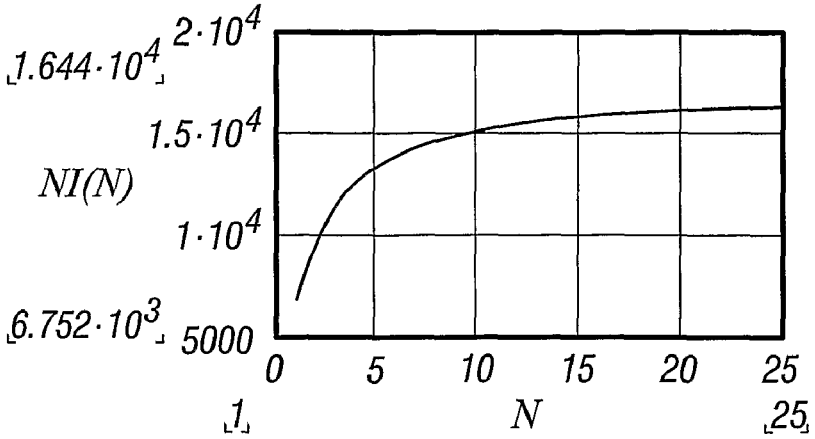
FIG. 8*a* illustrates a graph of ampere-turns versus the number of turns for #13AWG wire to generate activation, deactivation or reactivation energy for various circuit topologies in accordance with one embodiment of the present disclosure.
Figure 8B:
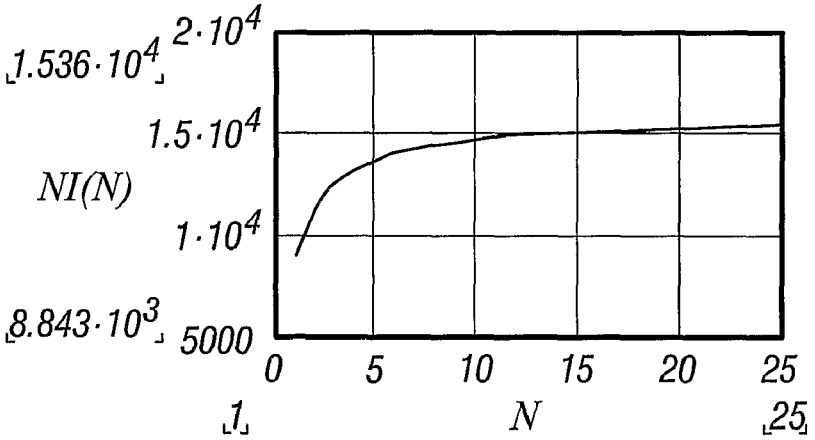
FIG. 8*b* illustrates a graph of ampere-turns versus the number of turns for #16AWG wire to generate activation, deactivation or reactivation energy for various circuit topologies.
Figure 8C:
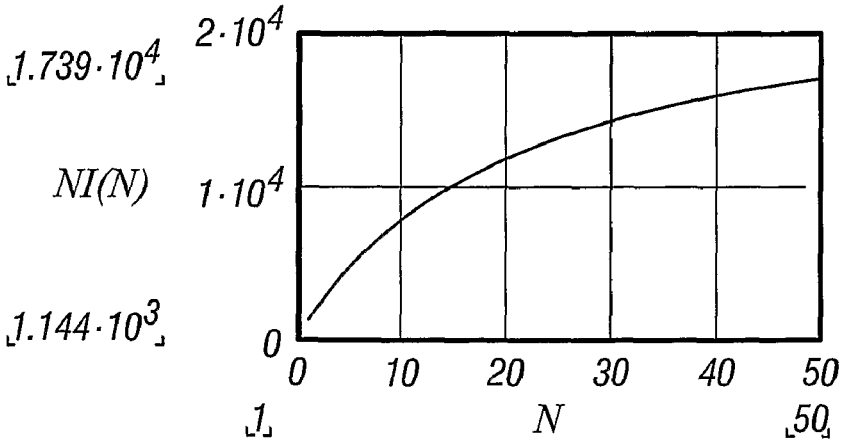
FIG. 8*c* illustrates a graph of ampere-turns versus the number of turns for #2AWG wire to generate activation, deactivation or reactivation energy for various circuit topologies.

FIGS. 8*a-c* shows the number of turns required to generate activation, deactivation or reactivation energy for various circuit topologies. In particular, FIG. 8*a* illustrates a graph of ampere-turns AT or NI(N) versus the number of turns N for #13AWG wire to generate activation, deactivation or reactivation energy for various circuit topologies in accordance with one embodiment. In FIG. 8*a*, the resistivity of the wire is $\rho=2003\cdot10^{-6}$ Ω/ft. For an AC/DC application such as is illustrated in FIG. 1*a*, V=110VDC. Notice that at N=10, the AT is about 15000.

FIG. 8*b* illustrates a graph of ampere-turns AT or NI(N) versus the number of turns N for #16AWG wire to generate activation, deactivation or reactivation energy for various circuit topologies in accordance with one embodiment. In FIG. 8*b*, the resistivity of the wire is $\rho=4016\cdot10^{-6}$ Ω/ft. For a DC/DC high voltage application such as is illustrated in FIG. 1*b*, V=200VDC. Notice that at N=14, the AT is about 15000.

FIG. 8*c* illustrates a graph of ampere-turns AT or NI(N) versus the number of turns N for #2AWG wire to generate activation, deactivation or reactivation energy for various circuit topologies in accordance with one embodiment. In FIG. 8*c*, the resistivity of the wire is $156\cdot10^{-6}$ Ω/ft. For a battery application such as is illustrated in FIG. 1*c*, V=12VDC. Notice that at N=30, the AT is about 15000.

For each instance illustrated in FIGS. 8*a* to 8*c*, the wire gauge can vary as smaller diameter wire can be used in higher voltage topologies.

With respect to the frequency of activation, deactivation or reactivation, the activation, deactivation or reactivation frequency increases as the current activation, deactivation or reactivation waveform decays because, as can be seen from FIG. 3, the interval between Switch "ON" times T1, T2, T3 and T4 decreases. That is, the positive and negative charging currents "I" are shut off earlier and earlier, corresponding to an increase in the deactivation frequency. The "ON" time of the switches SW1, SW2, SW3 and SW4, which are comprised of FETs, is calculated by solving Equations 1 and 2 for time "t".

A solution for charging time "t" is shown in Equation (12), as follows:

$$t(I)=-\tau\{1-(IR)/V\} \tag{12}$$

Figure 9:
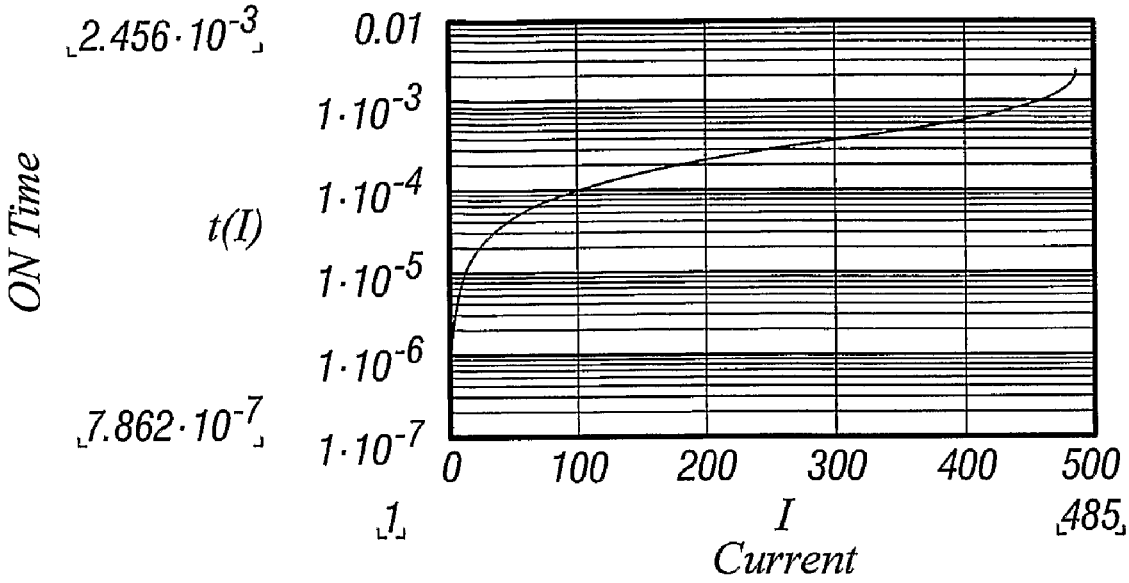
FIG. 9 illustrates a graph of ON charging time versus current for the H-bridge circuit of FIGS. 2*a*, 2*b* and 2*c* in accordance with one embodiment of the present disclosure.
Figure 10:
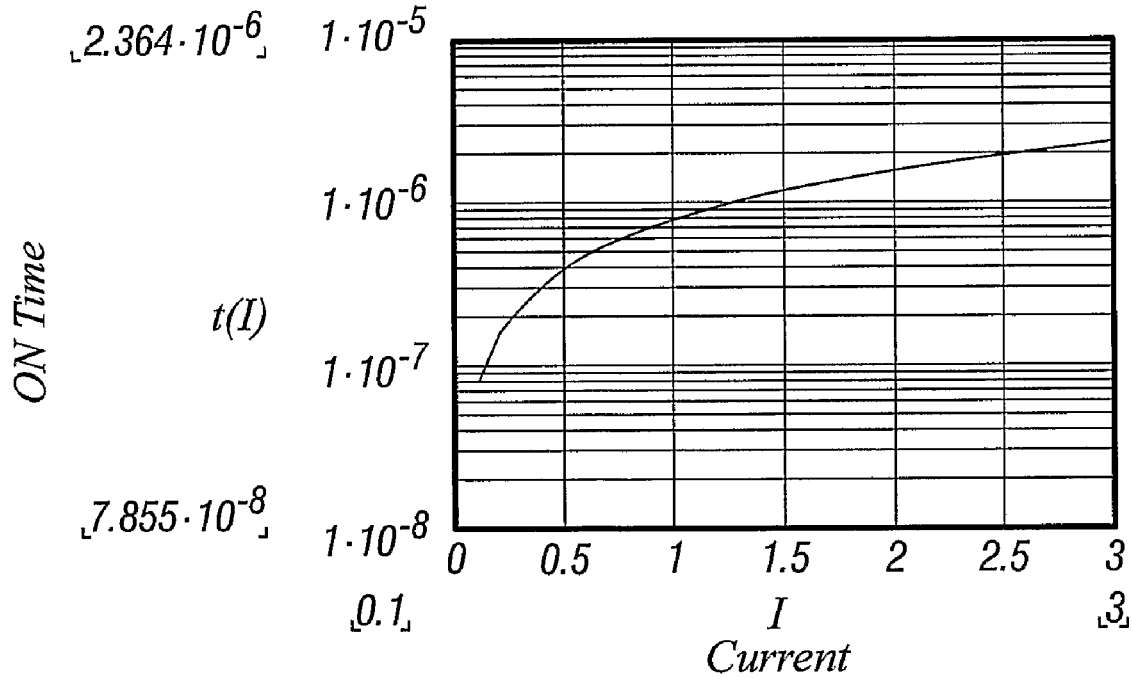
FIG. 10 illustrates an enlarged view of the graph of ON charging time versus current for the H-bridge circuit of FIG. 9 in accordance with one embodiment of the present disclosure.

FIG. 9 illustrates a graph of "ON" charging time "t" versus current "I" for the H-bridge circuit of FIGS. 2*a*, 2*b* and 2*c* in accordance with one embodiment. FIG. 10 illustrates an enlarged view of the graph of "ON" charging time versus current for the H-bridge circuit of FIG. 9 in accordance with one embodiment.

A solution for discharging time "t" is shown in Equation (13), as follows:

$$t(I)=-\tau\{(IR)/V\} \tag{13}$$

Those skilled in the art recognize that plots of discharge time "t" versus current "I" can be computed and plotted in a similar manner to the charge time "t" based on Equation (12) and the graphs of FIG. 9 and FIG. 10.

Based on the foregoing, and referring to FIGS. 1*a*-1*c*, 2*a*-2*c*, and 3-7, it can be understood that a method is disclosed for activating or deactivating or reactivating an EAS tag 130 which includes the steps of: providing an H-bridge circuit 108 coupled to an antenna 110; applying a source of current via line 106 to the H-bridge circuit 108; and directing an increasing current flow I through the antenna 110 in a first direction, thereby generating a positive increasing magnetic field M from the antenna, or directing a decreasing current flow I through the antenna 110 in the first direction, thereby generating a positive decreasing magnetic field M from the antenna 110; directing an increasing current flow I through the antenna 110 in a second direction such that direction of current flow I through the antenna 110 is in a direction reverse to that of direction of current flow I in the first direction, thereby generating a negative increasing magnetic field M from the antenna 110, or directing a decreasing current flow I through the antenna 110 in the second direction, thereby generating a negative decreasing magnetic field M from the antenna 110.

The method may be implemented such that the antenna 110 includes first and second ends for directing current I through the antenna 110 and the H-bridge circuit 108 includes first, second, third and fourth switches SW1, SW2, SW3 and SW4, respectively. The first and third switches SW1 and SW3 may be coupled to a first junction 1; the second and fourth switches SW2 and SW4 may be coupled to a second junction 2; the first and the fourth switches SW1 and SW4 may be coupled to a third junction 3; and the third switch SW3 and the second switch SW2 may be coupled to a fourth junction 4. The first end 110*a* of the antenna 110 may be coupled to the third junction 3 and the second end 110*b* of the antenna 110 may be coupled to the fourth junction 4. The first switch SW1 may control current I between the first junction 1 and the third junction 3; the second switch SW2 may control current I between the second junction 2 and the fourth junction 4; the third switch SW3 may control current I between the first junction 1 and the fourth junction 4; and the fourth switch SW4 may control current I between the second junction 2 and the third junction 3.

The method may further be implemented such that the step of directing an increasing current flow I through the antenna 110 in a first direction is performed by: connecting the current source via line 106 between the first and second junctions, 1 and 2; opening the third and fourth switches, SW3 and SW4, closing the first switch SW1 to direct current I from the first junction 1 to the third junction 3; and closing the second switch SW2 to direct current I from the fourth junction 4 to the second junction 2, thereby directing from the third junction 3 to the fourth junction 4 an increasing current I through the antenna 110 in the first direction to generate the positive increasing magnetic field M.

The method may further be implemented such that the step of directing a decreasing current flow I through the antenna 110 in a first direction is performed by: disconnecting the current source via line 106 between the first and second junctions 1 and 2; opening the first, third and fourth switches SW1, SW3 and SW4; and closing the second switch SW2, thereby directing a decreasing current I through the antenna 110 in the first direction from the third junction 3 to the fourth junction 4 to generate the positive decreasing magnetic field M.

The method may further be implemented such that the step of directing an increasing current flow I through the antenna 110 in a second direction is performed by: connecting the current source via line 106 between the first and second junctions 1 and 2; opening the first and second switches SW1 and SW2; closing the third switch SW3 to direct current I from the first junction 1 to the fourth junction 4; and closing the fourth switch SW4 to direct current I from the third junction 3 to the second junction 2, thereby directing from the fourth 4 junction to the third junction 3 increasing current I through the antenna 110 in a second direction to generate the negative increasing magnetic field M.

The method may further be implemented such that the step of directing a decreasing current flow through the antenna in the second direction is performed by: disconnecting the current source between the first and second junctions; opening the first, second and third switches; and closing the fourth switch, thereby directing decreasing current through the antenna in the second direction from the fourth junction to the third junction to generate the negative decreasing magnetic field.

As a result of the foregoing, the present disclosure provides an alternate method for activation, deactivation or reactivation of an EAS acoustomagnetically activated tag by utilizing an H-bridge circuit to generate the alternating and decaying currents required for activation, deactivation or reactivation. The present disclosure enables low voltage activation, deactivation or reactivation of an EAS tag, e.g., at voltage levels of 12 to 24VDC, and ensures uninterruptible power for activation, deactivation or reactivation of an EAS tag in case of external power loss.

The present disclosure provides a portable apparatus for activation, deactivation or reactivation of an EAS tag and the activation, deactivation or reactivation can be performed without a high voltage capacitor that is required typically in large deactivation designs. The present disclosure provides alternate methods of activation, deactivation or reactivation so that a designer may optimize for a particular environment.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an application specific integrated circuit (ASIC), programmable logic device (PLD) or digital signal processor (DSP), and so forth. In yet another example, an embodiment may be implemented by any combination of programmed general-purpose computer components and custom hardware components. The embodiments are not limited in this context.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. An apparatus for activating, deactivating or reactivating an electronic article surveillance (EAS) tag comprising:

an H-bridge circuit adapted to be coupled to a current source for applying current to the H-bridge circuit; and an antenna coupled to the H-bridge circuit such that current can flow through the antenna in at least a first and second direction, wherein the H-bridge circuit is configured to direct an increasing current flow through the antenna in the first direction, thereby generating a positive increasing magnetic field from the antenna;

wherein the H-bridge circuit is configured to direct a decreasing current flow through the antenna in the first direction, thereby generating a positive decreasing magnetic field from the antenna;

wherein the H-bridge circuit is configured to direct an increasing current flow through the antenna in the second direction such that current flow through the antenna reverses, thereby generating a negative increasing magnetic field from the antenna; and wherein the H-bridge circuit is configured to direct a decreasing current flow through the antenna in the second direction, thereby generating a negative decreasing magnetic field from the antenna.

2. The apparatus according to claim 1 wherein the H-bridge circuit comprises:

first, second, third and fourth switches;

wherein the antenna has first and second ends for directing current through the antenna;

wherein the first and third switches are coupled to a first junction, the second and fourth switches are coupled to a second junction, the fourth switch is coupled to the second junction, the first and fourth switches coupled to a third junction, the second and third switches coupled to a fourth junction, the first end of the antenna coupled to the third junction, the second end of the antenna coupled to the fourth junction; and wherein the first switch controls current between the first junction and the third junction, the second switch controls current between the second junction and the fourth junction, the third switch controls current between the first junction and the fourth junction, and the fourth switch controls current between the second junction and the third junction.

3. The apparatus according to claim 2, further comprising:

a circuit controller electrically associated with the H-bridge circuit and being configured to control the circuit; and a current source.

4. The apparatus according to claim 3, wherein the current source is a source of DC power.

5. The apparatus according to claim 4, wherein following connection of the source of DC power between the first and second junctions, the circuit controller controls the circuit to generate in at least a first cycle a positive increasing magnetic field from the antenna by:

opening the third and fourth switches;

closing the first switch to direct current from the first junction to the third junction; and closing the second switch to direct current from the fourth junction to the second junction, thereby directing from the third junction to the fourth junction an increasing current through the antenna in the first direction.

6. The apparatus according to claim 5, wherein the circuit controller further controls the circuit to generate in the at least a first cycle a positive decreasing magnetic field from the antenna by:

disconnecting the source of DC power between the first and second junctions;

opening the first, third and fourth switches; and closing the second switch, thereby directing a decreasing current through the antenna in the first direction from the third junction to the fourth junction.

7. The apparatus according to claim 6, wherein the circuit controller further controls the circuit to generate in the at least a first cycle a negative increasing magnetic field from the antenna by:

connecting a source of DC power between the first and second junctions;

opening the first and second switches;

closing the third switch to direct current from the first junction to the fourth junction; and closing the fourth switch to direct current from the third junction to the second junction, thereby directing from the fourth junction to the third junction increasing current through the antenna in the second direction.

8. The apparatus according to claim 7, wherein the circuit controller further controls the circuit to generate in the at least a first cycle a negative decreasing magnetic field from the antenna by:

disconnecting the source of DC power between the first and second junctions;

opening the first switch;

opening the second switch;

opening the third switch;

closing the fourth switch, thereby directing decreasing current through the antenna in the second direction from the fourth junction to the third junction.

9. The apparatus according to claim 5, wherein cycle time of the at least a first cycle exceeds cycle time of a second cycle, and cycle time of each succeeding cycle consecutively decreases with respect to the cycle time of the second cycle.

10. The apparatus according to claim 6, wherein cycle time of the first cycle exceeds cycle time of the second cycle, and cycle time of each succeeding cycle consecutively decreases with respect to the cycle time of the second cycle.

11. The apparatus according to claim 7, wherein cycle time of the first cycle exceeds cycle time of the second cycle, and cycle time of each succeeding cycle consecutively decreases with respect to the cycle time of the second cycle.

12. The apparatus according to claim 8, wherein cycle time of the first cycle exceeds cycle time of the second cycle, and cycle time of each succeeding cycle consecutively decreases with respect to the cycle time of the second cycle.

13. The apparatus according to claim 4, wherein the source of DC power comprises an AC/DC converter, the AC/DC converter adapted to be coupled to a source of AC power.

14. The apparatus according to claim 13, wherein the source of DC power further comprises a DC/DC High Voltage converter coupled to the AC/DC converter, the DC/DC High Voltage converter providing DC High Voltage output to the first and second junctions.

15. The apparatus according to claim 4, wherein the source of DC power comprises a battery.

16. The apparatus according to claim 15, wherein the source of DC power further comprises an AC/DC charger coupled to the battery, the AC/DC charger adapted to be coupled to a source of AC power.

17. The apparatus according to claim 13, wherein voltage output of the AC/DC converter is one of 12 VDC, 24 VDC, and 110 VDC.

18. The apparatus according to claim 14, wherein the DC High Voltage output from the DC/DC High Voltage converter is greater than 110 VDC.

19. The apparatus according to claim 15, wherein voltage output of the battery is one of 12 VDC and 24 VDC.

20. The apparatus according to claim 16, wherein voltage output of the AC/DC charger is one of 12 VDC and 24 VDC.

* * * * *